US007222627B1

(12) United States Patent
Johns

(10) Patent No.: US 7,222,627 B1
(45) Date of Patent: May 29, 2007

(54) APPARATUS AND METHOD FOR HAIR ENHANCEMENT

(76) Inventor: Arthur D. Johns, 909 N. Sierra Bonita Ave., Hollywood, CA (US) 90046

( * ) Notice: Subject to any disclaimer, the term of this patent is extended or adjusted under 35 U.S.C. 154(b) by 275 days.

(21) Appl. No.: 10/712,538

(22) Filed: Nov. 12, 2003

(51) Int. Cl.
*A41G 5/00* (2006.01)
*A41G 3/00* (2006.01)

(52) U.S. Cl. ..... 132/54; 132/201; 132/53

(58) Field of Classification Search ..... 132/201, 132/53–56
See application file for complete search history.

(56) References Cited

U.S. PATENT DOCUMENTS

| | | | | |
|---|---|---|---|---|
| 373,297 | A | 11/1887 | Marshall | |
| 1,133,196 | A | 3/1915 | Teugler | |
| 1,424,845 | A | 8/1922 | Nolan | |
| 1,444,040 | A * | 2/1923 | Russo | 132/54 |
| 1,634,190 | A | 6/1927 | Hepner | |
| 1,638,016 | A | 8/1927 | Oppenheim | |
| 2,438,005 | A * | 3/1948 | Goldman | 132/53 |
| 3,273,570 | A | 9/1966 | Allison | |
| 3,435,832 | A * | 4/1969 | Ito | 132/54 |
| 3,628,546 | A * | 12/1971 | Ensminger | 132/53 |
| 3,645,279 | A * | 2/1972 | Imre | 132/53 |
| 3,659,621 | A * | 5/1972 | Tucciarone et al. | 132/53 |
| 3,734,105 | A | 5/1973 | Borghese | |
| 4,171,001 | A | 10/1979 | Leonard et al. | |
| 4,386,619 | A * | 6/1983 | Williams | 132/53 |
| 4,576,189 | A | 3/1986 | Regina | |
| 4,606,359 | A | 8/1986 | Palumbo et al. | |
| 5,010,914 | A | 4/1991 | Merges | |
| 5,368,052 | A | 11/1994 | Finamore | |
| 5,406,971 | A | 4/1995 | Taylor | |
| 5,687,750 | A | 11/1997 | Belmonte et al. | |
| 5,873,373 | A * | 2/1999 | Narvick | 132/54 |
| 5,979,462 | A | 11/1999 | Jones | |
| 6,105,584 | A | 8/2000 | Williams | |
| D439,014 | S | 3/2001 | Pender | |
| 6,220,249 | B1 | 4/2001 | Park | |
| 6,257,244 | B1 | 7/2001 | Williams | |
| 2001/0013351 | A1 | 8/2001 | Tang | |
| 2002/0189627 | A1 | 12/2002 | Tang | |
| 2003/0075196 | A1 | 4/2003 | Fair | |
| 2004/0237985 | A1 * | 12/2004 | Ball | 132/54 |

FOREIGN PATENT DOCUMENTS

| | | | |
|---|---|---|---|
| JP | 04214402 A * | 8/1992 | |

* cited by examiner

*Primary Examiner*—John J. Wilson
(74) *Attorney, Agent, or Firm*—Blakely, Sokoloff, Taylor & Zafman LLP

(57) ABSTRACT

A method and device for a hair enhancement device. The device may include a peripheral member sized to fit a rear portion of a human head and comprised of a flexible, non-elastic material. The periphery may include a longitudinal member coupled thereto to bisect the periphery and define an upper portion and lower portion of the hair enhancement device. Diagonal members may be coupled between the longitudinal member and the circular member distal from the longitudinal member to subdivide the device into geometric regions. Wefts of hair may be connected to the longitudinal and/or diagonal members and, possibly the peripheral member. A protective sleeve may be sewn over a foundation of the device. The hair of a wearer is drawn through the geometric regions for blending with the wefts of hair.

18 Claims, 6 Drawing Sheets

FIG. 9
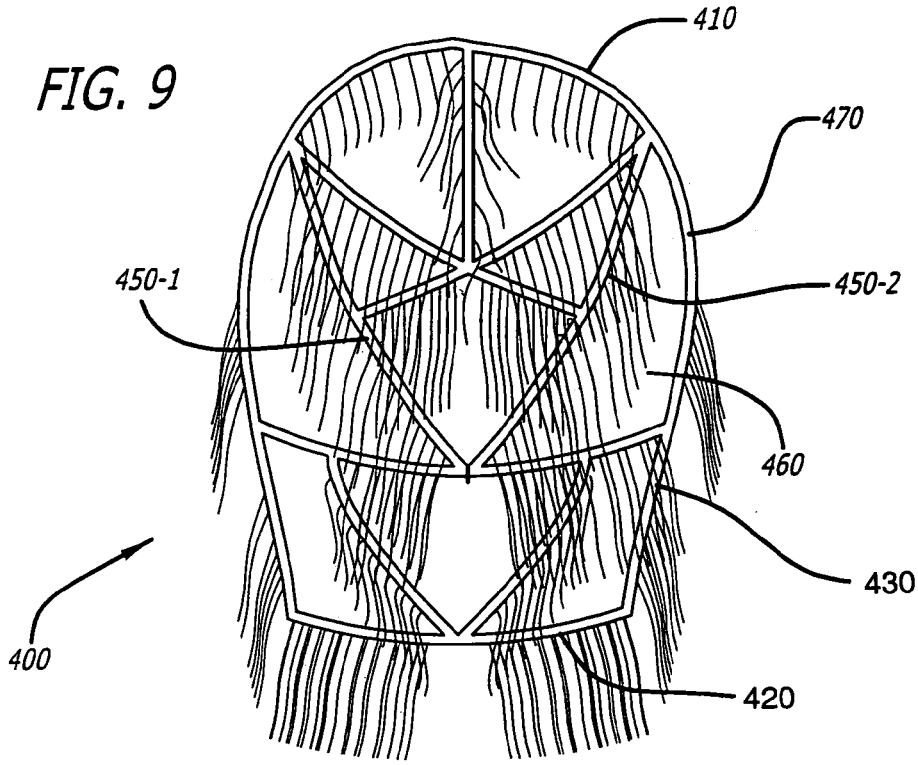
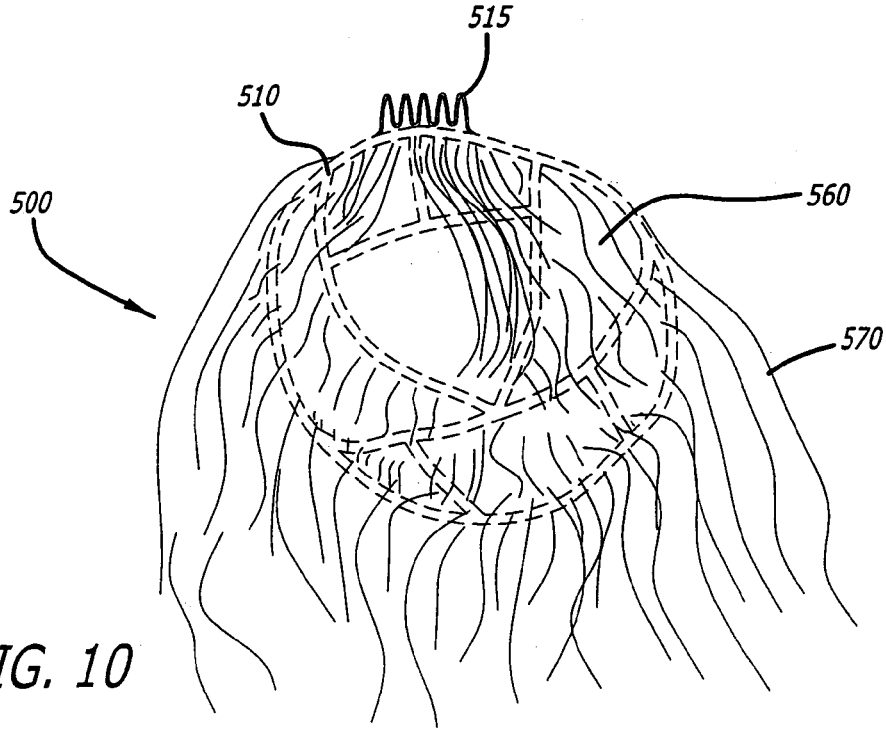
FIG. 10

APPARATUS AND METHOD FOR HAIR ENHANCEMENT

FIELD

Hair enhancement.

BACKGROUND

Wigs, as well as other hair replacement devices are typically used as a remedy for pattern baldness or to change a complete look (e.g., color) or style of an individual's hair. Conversely, hair enhancement devices are typically constructed to augment an individual's hair and therefore do not provide a remedy for pattern baldness or completely change a look or style. Examples of hair enhancement devices include, but are not limited to, adding volume and/or length to an individual's existing hair.

Hair replacement devices, such as wigs are typically constructed for replacement of an individual's remaining hair and therefore obscure the individual's remaining hair or lack thereof. As a result, wigs generally require a relatively tight fit on the scalp, particularly around the periphery of the individual wearer to provide stability. Generally, wigs are constructed from material simulating skin from mesh or net-like materials or from plastic frameworks.

Unfortunately, various problems arise to the individual wearer of a wig when a wig is worn for more than a brief period of time. For example, wigs may provide pressure or pinching on the individual wearer's scalp as a result of the relatively tight fit associated with wigs. Furthermore, the material used to form the inner portion of the wig excessively heats the scalp of the individual wearer. As a result, more open framework designs, including mesh or net wigs were developed to resolved these problems. Unfortunately, such designs are unable to meet general requirements of the wigs. For example, such wigs may lack stability or may include undesirable bulk, as well as discomfort to the individual wearer.

Variations of hair replacement devices may be constructed to augment the hair of an individual wearer, such as thinning hair and provide an alternative to the full wig. For example, such hair replacement devices may be constructed with an open framework of hair dyed, glued or sewn thereto. Representatively, an individual's hair is drawn through open areas of the framework and inner-mixed with the hair of the device.

Generally, such hair replacement devices must closely fit the contours of the individual's scalp to allow the hair to be inner-mixed, typically by combining. Furthermore, such devices must be constructed from materials that retain their shape over time to prevent sagging from the weight of the attached hair and from incidental tugging or snagging as the hair is blended. Additionally, connections between segments of the opening framework should be relatively strong, without providing bulk, to withstand incidental tugging or snagging as the hair is blended.

Hair replacement devices such as describe above generally enclose the entire head or scalp of an individual. As a result, placement of such hair replacement devices of an individual may require assistance, especially with regards to blending of the individual's hair with that of these hair replacement devices. As a result, such hair replacement devices may be successful for individuals with thinning hair. However, for individuals that desire hair enhancement by, for example, a means of additional volume or length, can generally not receive such benefits from these hair replacement devices. Therefore, there remains a need to overcome one or more of the limitations in the above-described existing.

BRIEF DESCRIPTION OF THE DRAWINGS

The claims are illustrated by way of example, and not by way of limitation, in the figures of the accompanying drawings and in which:

FIG. 9 is a rear side view of another embodiment of a hair enhancement device.

FIG. 10 is a rear side view of another embodiment of a hair enhancement device.

DETAILED DESCRIPTION

A method and device suitable for hair enhancement are described. In the following description, for the purposes of explanation, numerous specific details are set forth. It will be apparent, however, to one skilled in the art that the claimed subject matter may be practiced without some of these specific details. In addition, the following description provides examples, and the accompanying drawings show various examples for the purposes of illustration. However, these examples should not be construed in a limiting sense as they are merely intended to provide examples of the claimed subject matter rather than to provide an exhaustive list of all possible implementations of the claimed subject matter.

Figure 1A:
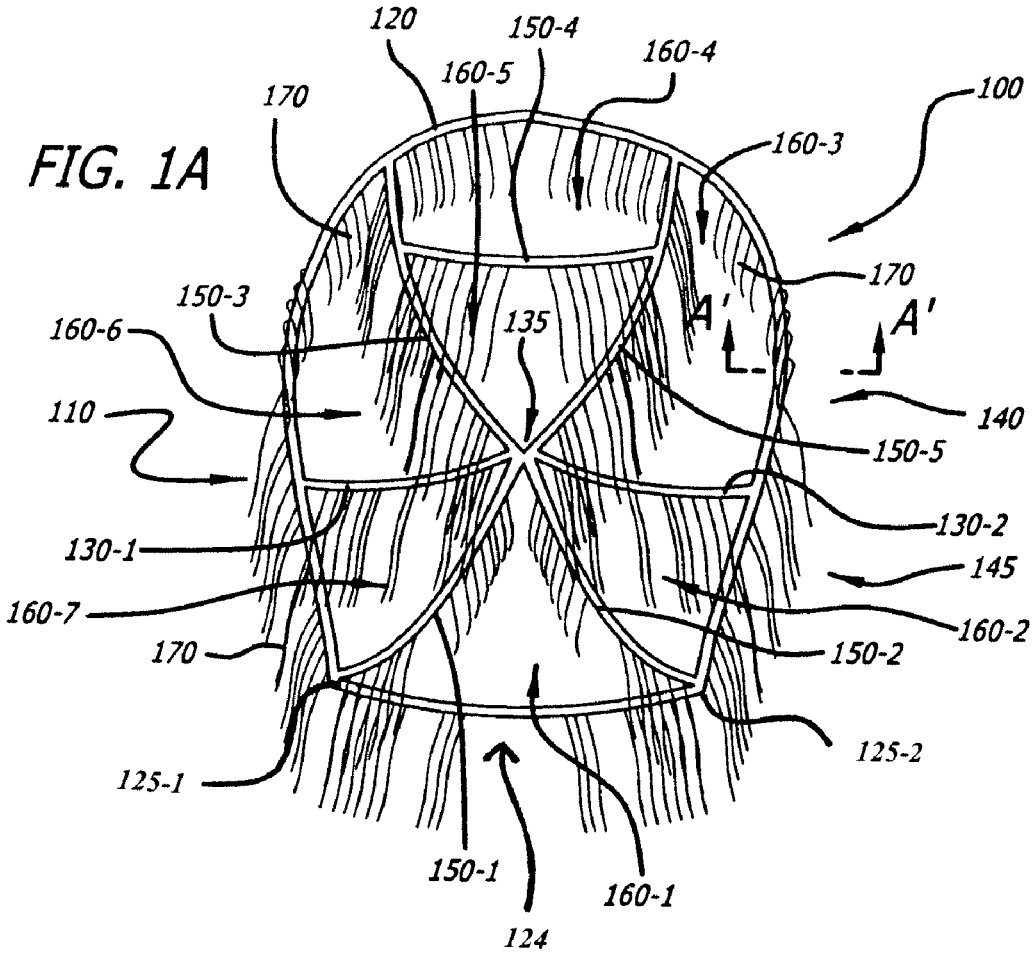
FIG. 1A is rear side view of a portion of an embodiment of a device suitable as a hair enhancement device, the portion including a periphery and longitudinal members.

FIG. 1A shows a rear side of a device suitable for use as a hair enhancement device. Device 100 includes, in this embodiment, foundation 110 that is configured to fit an individual wearer's (male or female) head. Generally, as illustrated in subsequent figures foundation 110 is configured to fit (be connected or fitted to) a rear portion of a wearer's head, as opposed to the entire head. Referring to FIG. 1A, foundation 110 includes peripheral member 120 and longitudinal member 130-1 and 130-2. Peripheral member 120 may have a generally circular shape, including, but not limited to, a substantially horseshoe shape. In one embodiment, a horseshoe shape peripheral member 120 may have heel 124 defined by corners 125-1 and 125-2. Longitudinal members 130-1 and 130-2 are coupled together at proximal ends and are each connected at distal ends to peripheral member 120. Longitudinal members 130-1 and 130-2 collectively bisect peripheral member into two equal or unequal portions, first portion 140 and second portion 145.

Foundation 110 also includes, in this embodiment, a number of diagonal members (e.g., 150-1, 150-2, 150-3, 150-5) connected at their respective ends (two ends) to peripheral member 120 and longitudinal members 130-1 and/or 130-2. Diagonal member 150-4 extends laterally and is connected at its ends to diagonal member 150-3 and diagonal member 150-5, respectively, in first portion 140. In this manner, the diagonal members divide first portion 140 and second portion 145 into a number of geometric regions (e.g., geometric regions 160-1, 160-2, 160-3, 160-5, 160-6 and 160-7).

Representatively, the diagonal members divide first portion 140 and second portion 145 into geometric regions approximating triangles (e.g. spherical triangles). In the embodiment illustrated, longitudinal members 130-1 and 130-2 and the diagonal members 150-1, 150-2, 150-3 and 150-4 form a "starfish" like pattern with ends of each meeting at node 135. As further illustrated in this embodiment, opposite ends of the diagonal members, for example diagonal members 150-1 and 150-2, may meet at corner 125-1 and corner 125-2, respectively, of peripheral member 120 to divide second portion 145 into geometric regions (e.g., 160-1, 160-2 and 160-7). It is appreciated that the diagonal members may form different shaped regions (e.g., shapes other than triangles) or a combination of multiple shaped regions of first portion 140 and second portion 145.

Foundation 110 of device 100, in one embodiment, is made of a wire strand or strands representing peripheral member 120, longitudinal member 130-1, longitudinal member 130-2 and the diagonal members (e.g., diagonal members 150-1, 150-2, 150-3, 150-4, 150-5). A suitable form of wire is an aluminum alloy or steel material having a representative gauge in the range of, for example, 27 to 19 gauge. Overlying the wire portion of the various members is a cloth material. Representatively, the cloth is folded over and its sides are sewn together to enclose the wire within the cloth material. Representative widths of cloth material to encompass a 20 gauge wire include widths on the order of 0.25 to 0.5 inches.

In addition to foundation 110, device 100 also includes wefts of hair 170. Wefts of hair 170 are, for example, wefts of natural or synthetic hair. Wefts of hair 170 contain natural or synthetic hair of a desired length as described herein. Wefts of hair 170 typically contain the hair by stitching (at weft 174). Wefts of hair 170 have a width, in one embodiment, equivalent (or in combination with another weft or wefts equivalent) to a length of the portion of foundation 110 to which the weft of hair will be attached (e.g., diagonal member 150-1, 150-2, 150-3, 150-4, 150-5); peripheral member 120 (e.g., between diagonal member 150-3 and diagonal member 150-5 and longitudinal member 130-2); and/or longitudinal member 130-1, and longitudinal member 130-2).

Figure 1B:
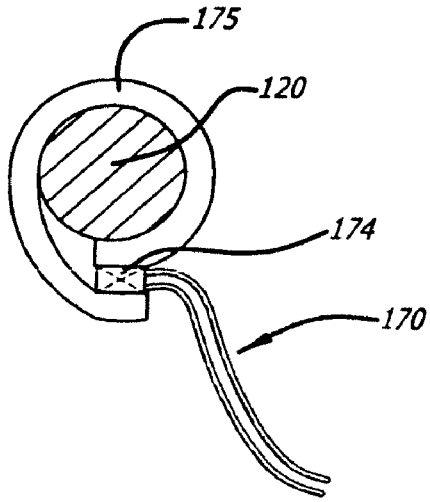
FIG. 1B is a cross-sectional view through line A–A' of FIG. 1A.

Wefts of hair 170 may be affixed to one or more of peripheral member 120, longitudinal members 130-1 and 130-2, and/or one or more diagonal members 150. Representatively, wefts of hair 170 may be affixed to a cloth material 175 enclosing foundation 120 (see FIG. 1B). In one embodiment, wefts of hair 170 are affixed at one end into the inner or enclosed side of the cloth material 175. Suitable examples of affixing wefts of hair 170 to cloth material 175 include, but are not limited to, stitching or an adhesive. For example, the weft portion of wefts of hair 170 may be stitched or sewn to an inner or enclosed side (e.g., enclosed by joining or overlapping opposing sides of cloth material 175). Alternatively, wefts of hair 170 are affixed to the exterior of the enclosing cloth material 175. In a further embodiment, wefts of hair 170 are formed directly over foundation 110 (See FIGS. 12 and 13).

Figure 2:
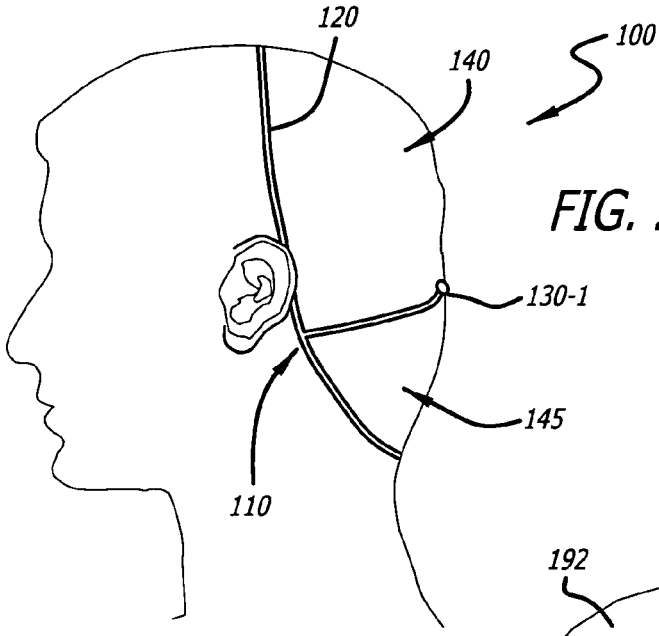
FIG. 2 is a side view of a portion of a foundation of the device of FIG. 1A on a head of an individual, the portion including a periphery and longitudinal members.

FIGS. 2–5 illustrate the formation of device 100 suitable for use in hair enhancement. Specifically, FIG. 2 shows a portion of device 100 including a portion of a framework suitable for fitting on the head of a wearer. Foundation 110, in this embodiment and view, includes generally circular peripheral member 120 and longitudinal member 130-1. As illustrated in FIG. 2, foundation 110 is shown without any diagonal members or wefts of hair.

Figure 3:
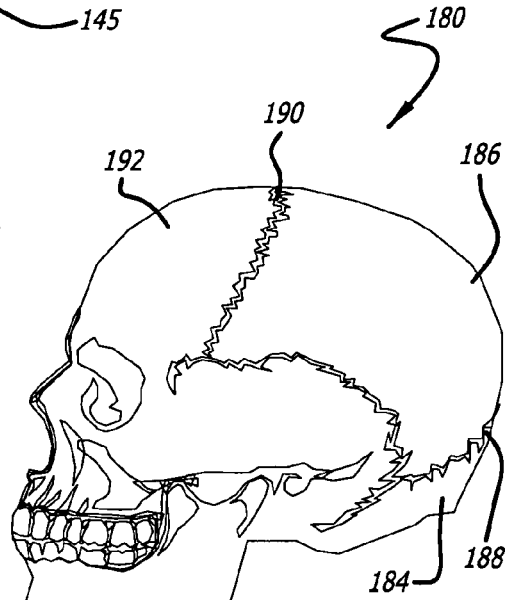
FIG. 3 is a side view of a human skull, depicting areas of the human skull in which a device, such as the device of FIG. 1A may be positioned.

Generally, as illustrated with reference to FIG. 2 and FIG. 3, hair enhancement device 100 is designed such that peripheral member 120 of foundation 110 encloses occipital 184 and parietal 186 portions of an individual wearer's head 180. In one embodiment, placement of longitudinal member 130-1 (FIG. 2) bisects peripheral member 120 and generally runs laterally between, for example, the ears of an individual wearer 280 and along occipital bone 188 (FIG. 3) to divide peripheral member 120 into first portion 140 (upper portion as viewed) and second portion 145 (lower portion as viewed).

In the embodiment described herein, first portion 140 may be referred to as a crown portion of peripheral member 120, whereas second portion 145 may be referred to as a nape portion of peripheral member 120 of device 100. As such, in the embodiment described, first portion 140 may run from occipital bone 188 of an individual wearer's head 180 up to a crown portion 140 of the individual wearer's head 180 prior to coronal structure 190 of frontal portion 192 of individual wearer's head 180 (FIG. 3). In another embodiment, the foundation (including a first portion and a second portion) may cover a larger portion of, a wearer's head, for example, from frontal portion 192 to occipital bone 188. Once first portion 140 and second portion 145 of device 100 are defined, the portions are divided into geometric regions based on a desired style provided by device 100.

Figure 4:
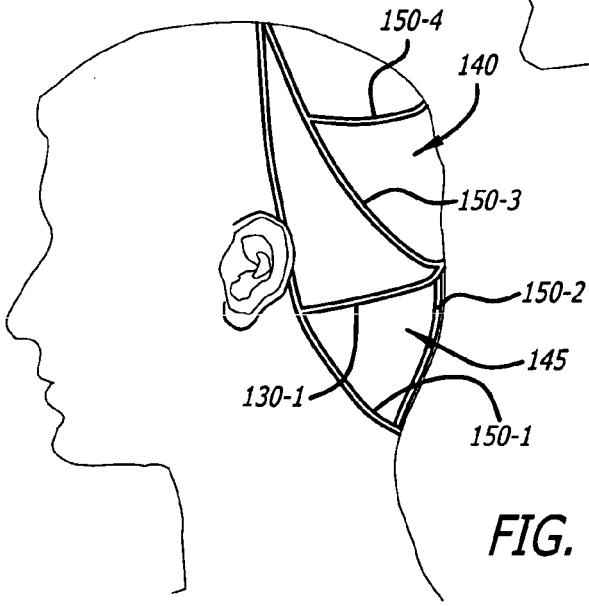
FIG. 4 is a side view of a portion of a foundation of the device of FIG. 1A on a head of an individual further illustrating peripheral, longitudinal and diagonal members of the device.

In one embodiment, as illustrated with reference to FIG. 4, diagonal members 150 (150-1, . . . , 150-N) divide first portion 140 and second portion 145 into geometric regions 160 (160-1, . . . , 160-7) (FIG. 1A), such as for example, triangles or spherical triangles. In one embodiment, a portion of diagonal members 150 connect between longitudinal member 130-1 (and diagonal member 130-2) and peripheral member 120. Likewise, additional diagonal members 150 (e.g., 150-4) may be connected between other diagonal members to further subdivide a desired portion of the framework of device 100 into additional geometric regions, such as triangles or other shapes. Representative widths of regions 160 (as measured from, for example, distal vertices) fall within the range of two (2) inches to four (4) or more inches.

Collectively, peripheral member 120, longitudinal member 120-1, longitudinal member 120-2 and diagonal members 150 form foundation 110 of hair enhancement device 100. In one aspect, dividing the framework of foundation 110 of device 100 into regions determines the amount and location of a wearer's natural hair that may be pulled through regions 160 and over foundation 110 to blend with wefts of hair 170. By arranging geometric regions 160, effects such as, additional fullness or length may be achieved.

Once the desired foundation 110 of device 100 is designed, individual wefts of hair 170 may be individually connected to foundation 110 including peripheral member 120, longitudinal member 130 and one or more diagonal members 150. One way this may be achieved is by wrapping foundation 110 of a wire or strands of wire with cloth material 175 and affixing (e.g., stitching, gluing) wefts of hair 170 to cloth material 175 (See FIGS. 1A and 1B). In one embodiment, wefts of hair are wrapped and sewn around selected members of foundation 110. In the example, where wefts of hair 170 are sewn to foundation 110, the thread or string 174 or other material used to sew the wefts over the various members of foundation 110 of hair enhancement device 100 may be dyed to a color of the hair to further disguise the wefts of hair. Likewise, the wefts of hair may be sewn onto the individual members of foundation 110 to provide a directional path for the hair to provide enhanced styling.

Figure 5:
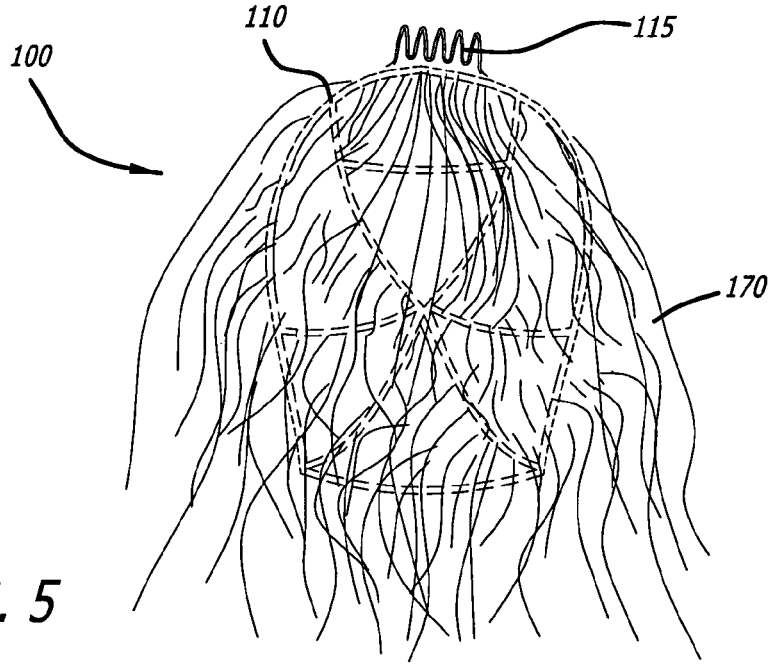
FIG. 5 is a rear side view of the hair enhancement device of FIG. 1A on an individual's head.

Accordingly, once individual wefts of hair 170 are connected to a portion (including the entire portion) of foundation 110 of device 100, hair enhancement device 100 may be placed on an individual wearer's head. FIG. 5 shows an embodiment of device 100 on a rear portion of an individual wearer's head. In one embodiment, foundation 110 of device 100 includes a flexible, generally non-elastic material, such as for example, a wire.

Accordingly, hair enhancement device 100 may be secured to, for example, a crown portion of an individual wearer's head 180 (FIG. 3) and then shaped to the individual wearer's head by applying pressure to the wire to enable a comfortable fit. In the embodiment shown in FIG. 5, hair enhancement device 100 also includes hair clip 115 positioned and affixed at, in this embodiment, an apex of foundation 110 (as viewed). Hair clip 15 may be any type of clip commonly used to secure hair. Hair clip 15 may serve, in one aspect, to further secure hair enhancement device 100 to an individual wearer's head (e.g., to existing hair on the individual wearer's head).

In one embodiment, the configuration of foundation 110 of hair enhancement device 100 and/or the amount and placement of wefts of hair 170 on foundation 110 are selected to achieve a certain look, accentuating an individual wearer's hair. Examples of accentuation include, but are not limited to, adding length and/or volume.

As is illustrated, wefts of hair 170 may be connected to each longitudinal member 130-1 and longitudinal member 130-2, as well as to each diagonal member 150-1, 150-2, 150-3, 150-4, and 150-5. Wefts of hair 170 connected to one or more of longitudinal member 130-1 and longitudinal member 130-2 and diagonal members 150-1 and 150-2 in lower portion 145 of foundation 110 may be longer than an individual wearer's hair when hair enhancement device 100 is placed on the individual wearer's head. Once hair enhancement device 100 is in place on an individual wearer's head, the wearer will pull his/her natural hair through geometric regions 160-1, 160-2, 160-3, 160-4, 160-5, 160-6, and 160-7 and over diagonal members 150-1, 150-2, 150-3, 150-4 and 150-5 and longitudinal members 130-1 and 130-2. The length of wefts of hair 170 may extend beyond the individual wearer's head to provide a shoulder length hair style.

In this manner, the individual wearer's natural hair conceals foundation 110 and may be combined (blended) with wefts of hair 170. Depending on the amount and placement of wefts of hair 170 on foundation 110 of hair enhancement device 100, an appearance of volume or fullness of an individual wearer's hair may be enhanced due to the collective amount (wefts of hair 170 plus natural hair) when hair enhancement device 100 is in place. For example, for a person with generally long hair (shoulder length or beyond), by placing wefts of hair 170 on longitudinal member 130-1 and 130-2 (and/or on diagonal members 150-1 and 150-2), the combined amount of hair on an individual wearer's head will be greater than without hair enhancement device 100, thus giving the appearance of more fullness.

Figure 6:
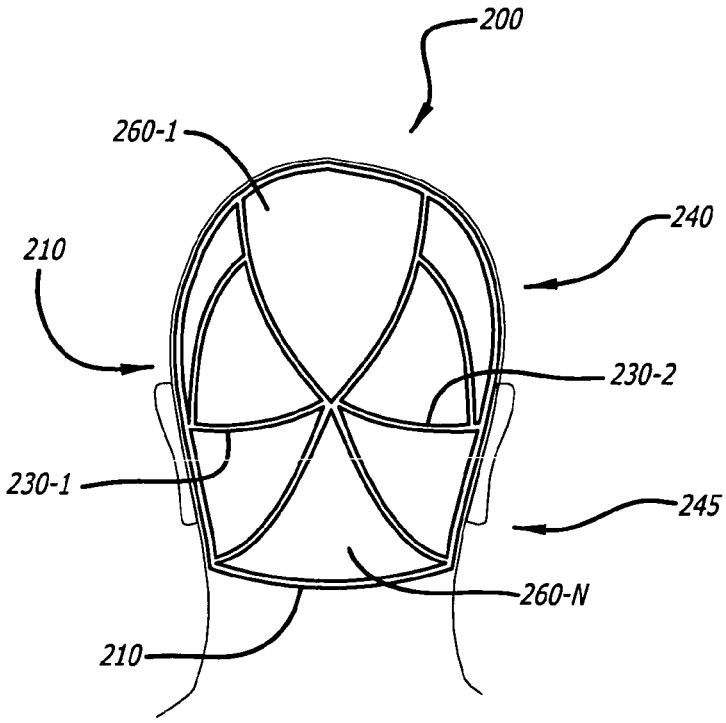
FIG. 6 is a rear side view of a portion of another embodiment of a foundation of a hair enhancement device, as viewed from a rear portion of an individual's head.

FIG. 6 shows another embodiment of a hair enhancement device, shown for clarity without wefts of hair attached to the device. Hair enhancement device 200 includes, in this embodiment, foundation 210 including peripheral member 220 bisected by longitudinal member 230-1 and longitudinal member 230-2. For illustration, foundation 210 is shown on the back of an individual wearer's head. Longitudinal member 230-2 defines first portion 240 and second portion 245. In this embodiment, first portion 240 includes five generally triangular portions 260 whereas first portion 230 includes three triangular portions 260.

The division of first portion 240 and second portion 245 of device 200 are determined, in one embodiment, based on a desired style provided by device 200. For example, to provide additional fullness or volume near the top of an individual wearer's head, additional geometric regions 260 may be provided within first portion 240. Conversely or additionally, when additional length is desired to an individual wearer's head or hair, additional geometric regions 260 may be added within second portion 245 to provide additional length, as well as fullness, to the hair. For example, hair enhancement device 200 may provide an individual wearer with a one length hair style.

Figure 7:
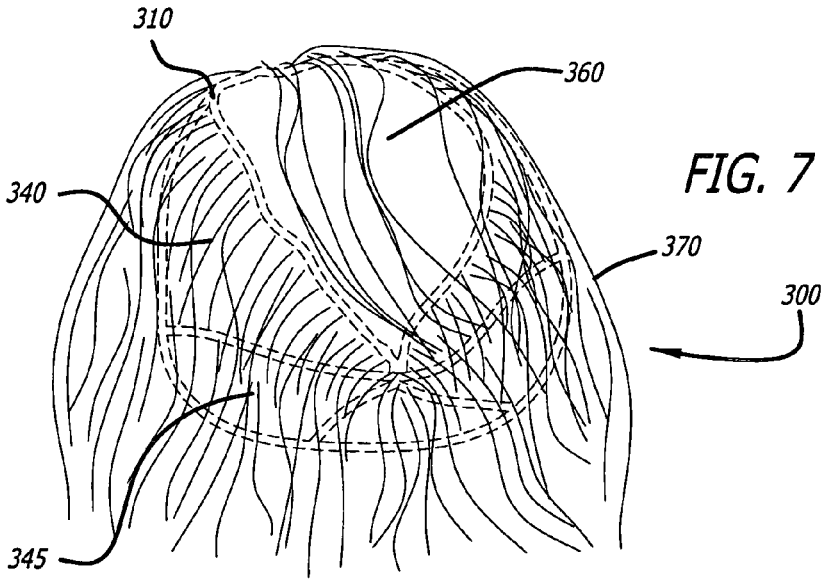
FIG. 7 is a top side view of another embodiment of a hair enhancement device.

FIG. 7 is a rear side view of a hair enhancement device in accordance with another embodiment. In the embodiment illustrated, hair enhancement device 300 includes foundation 310 configured with three geometric regions 360 in both first portion 340 and second portion 345 of device 300. According to the reduced number of geometric regions 360, device 300 may be used for chin-length hair styles, such as a one-length "bob" hair style. In other words, hair enhancement device 300 provides an individual wearer with a short, layered hair style.

Figure 8:
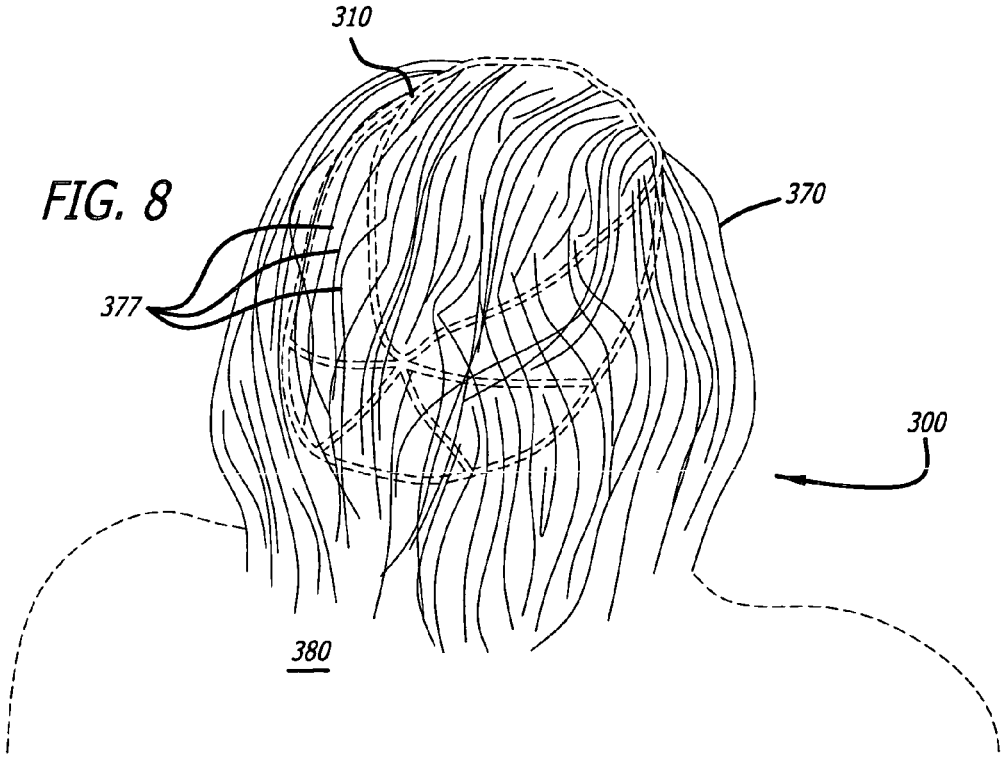
FIG. 8 is a top, rear side view of an embodiment of the device of FIG. 7, as worn by an individual.

FIG. 8 illustrates placement of device 300 on the head of an individual wearer 380. In this embodiment, an attachment device (not shown) secures device 300 to the head of individual wearer 380. Once secured, hair of the individual wearer 380 is pulled through various geometric regions 360 and overlies foundation 310. FIG. 8 schematically shows natural hair 377 pulled through (e.g., by the wearer's own hand), a geometric region of foundation 310. The wearer's hair is blended with the wefts of hair to provide a natural look and also obscure foundation 310 of hair enhancement device 300, as illustrated in FIG. 8.

FIG. 9 is a rear side view of another embodiment of a hair enhancement device. In the embodiment illustrated, hair enhancement device 400 includes foundation 410. Foundation 410 includes peripheral member 420 and longitudinal member 430 connected to peripheral member 420 at its ends (two ends) and bisecting peripheral member 420. Hair enhancement device 400, as illustrated in FIG. 9, is configured for application to individuals having more full hair as opposed to individuals with more fine hair. For example, hair enhancement device 400 may provide an individual wearer with a long, one length or layered hair style. Hence, wefts of hair 470 may be blended with the individual wearer's natural hair to provide an appearance that the individual wearer's hair is longer than naturally.

In this embodiment, geometric regions 460 of hair enhancement device 400 are larger, as compared to the embodiment of hair enhancement device illustrated in FIGS. 7 and 8 to enable an individual wearer to more easily pull their hair through regions 460. Accordingly, hair enhancement device 400 may be better suited for individuals with more hair volume that desire additional length by providing larger geometric regions 460 through which the individual wearer's hair is pulled through to achieve hair styles with shoulder length hair. Conversely, hair enhancement device 300 embodiment illustrated with reference to FIGS. 7 and 8 may be better suited for individuals with fine hair that desire additional volume by providing smaller geometric region 460 to achieve hair styles, such as a "bob" or less than shoulder length hair style.

FIG. 10 illustrates a hair enhancement device in accordance with the further embodiment. As illustrated, hair enhancement device 500 is constructed with fewer geometric regions 560 and includes a combination of triangular, as well as rectangular or square shaped geometric regions 560. As such, in the embodiment illustrated, hair enhancement device 500 may be more readily constructed and provides an embodiment for individuals typically with thicker, more voluminous hair. By providing larger geometric regions (as compared to FIG. 1A), thicker hair is more easily drawn through geometric regions 560. Furthermore, the reduced number of geometric regions allow foundation 510 of device 500 to remain flush with the individual wearer's scalp. As a result, device 500 provides an individual wearer with, for example, a short, one length hair style.

Figure 11:
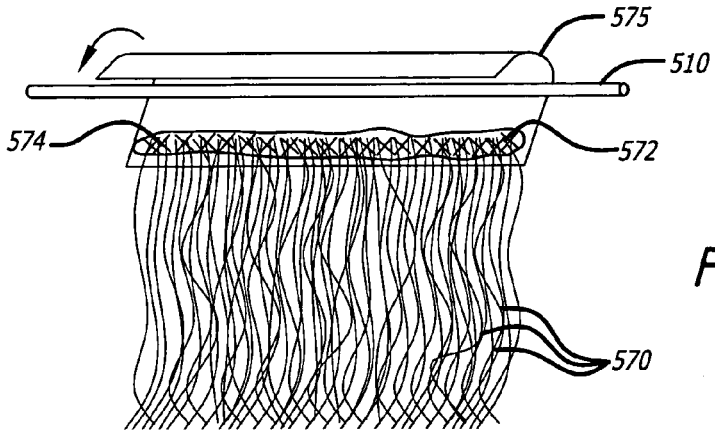
FIG. 11 illustrates a technique for coupling a weft of hair over the foundation of a hair enhancement device.

FIG. 11 shows one technique for attaching a weft of hair to a foundation of a hair enhancement device. FIG. 11 shows a portion of foundation 510 of, for example, a wire. As illustrated, weft of hair 570 is affixed to cloth material 575 at weft 574 with the hair hanging below cloth material 575 as viewed. In one embodiment, weft 574 may be sewn or stitched to cloth material 575. Once secured, cloth material 575 is wrapped around foundation 510. Subsequently, opposed sides of cloth material 575 are overlapped and are sewn, or glued or otherwise affixed together to secure weft 570 to foundation 510. Representatively, an inner portion of one side of cloth material 575, including weft 572 is overlapped and connected to an outer portion of the other side.

Figure 12:
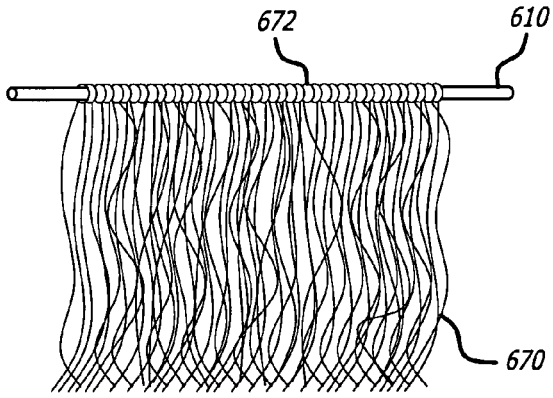
FIG. 12 illustrates techniques for forming a weft of hair over the foundation of a hair enhancement device.
Figure 13:
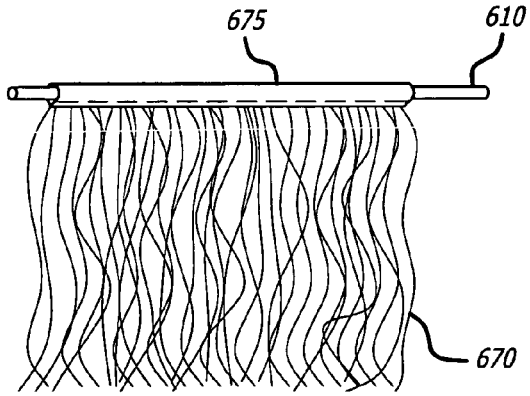
FIG. 13 illustrates techniques for forming a weft of hair over the foundation of a hair enhancement device.

FIG. 12 shows another technique for connecting hair to a hair enhance device, e.g., a foundation of a hair enhancement device. As illustrated in FIG. 12, in one embodiment, strands of hair 670 are formed directly over foundation 610, thereby enclosing and obscuring foundation 510 from view. Representatively, strands of hair are folded in half over foundation 610 and stitched to enclose the foundation with stitching 672, essentially forming a weft at foundation 610. In a further embodiment, as illustrated in FIG. 13, a protective sleeve of cloth material 675 is placed over the stitched portion 672 and foundation 610. Protective sleeve 675 is provided to prevent fraying of the affixed hair 670 to, in one aspect, increase the longevity of a hair enhancement device.

It is to be understood that even though numerous characteristics and advantages of various embodiments have been set forth in the foregoing description, together with details of the structure and function of various embodiments, this disclosure is illustrative. Changes may be made in detail, especially matters of structure and management of parts within the principles set forth herein to the full extent indicated by the broad general meaning of the terms in which the appended claims are expressed.

What is claimed is:

1. A device comprising:

a foundation comprising:

a generally peripheral member conformable to a substantially horseshoe shape with a heel having a first end defined by a first corner and a second end defined by a different second corner and sized to be worn on less than an entire portion of a scalp of a human head and enclose an occipital portion and a parietal portion of the human head;

a longitudinal member coupled to the peripheral member at one point and at another different point that bisects the peripheral member and defines a first portion and a second different portion of the peripheral member;

a plurality of diagonal members each respectively coupled to the longitudinal member and the peripheral member distal from the longitudinal member, wherein, when the peripheral member is worn on a head of a wearer in such a manner to enclose the occipital portion and the parietal portion, the longitudinal member extends laterally between ears of the wearer, and the plurality of diagonal members divide the first portion and the second portion into a plurality of geometric regions, the geometric regions of the second portion to overlay the occipital portion and one of the plurality of diagonal members in the second portion is coupled to the first corner of the peripheral member and at least another of the plurality of diagonal members in the second portion is coupled to the second corner of the peripheral member, each of the geometric regions of a dimension suitable to allow natural hair of a wearer of the foundation to be drawn through the geometric regions; and a plurality of wefts of hair coupled to the plurality of diagonal members.

2. The device of claim 1, wherein the peripheral member comprises a wire.

3. The device of claim 1, further comprising a clip coupled to a portion of the peripheral member adapted to engage a portion of natural hair of a wearer.

4. The device of claim 1, wherein the first portion of the peripheral member is adapted to be positioned onto a crown portion of an individual wearer's head between an occipital bone and a top of a parietal portion of the wearer's head.

5. The device of claim 4, wherein the second portion of the peripheral member encloses a nape portion of an individual wearer's head between an occipital bone and a base of the individual wearer's scalp.

6. The device of claim 1, wherein the geometric regions of the first portion and the second portion comprise triangles.

7. The device of claim 1, wherein the geometric regions of the first portion and the second portion comprise spherical triangles.

8. The device of claim 1, wherein the first portion of the peripheral member is adapted to be positioned on a crown portion of an individual wearer's head and a number of geometric regions within the first portion is selected to achieve a desired volume of an individual wearer's hair.

9. The device of claim 8, wherein a number of geometric regions within a second portion is determined based on a desired length of the individual wearer's hair.

10. The device of claim 1, wherein the foundation comprises a cloth material coupled at adjacent opposing side edges of the cloth material.

11. The device of claim 10, wherein the foundation comprises a wire and the cloth material surrounds the wire.

12. The device of claim 11, wherein the plurality of wefts of hair are coupled to the cloth material such that a weft portion of the plurality of wefts contacts a first side of the cloth material and a different side of the cloth material.

13. The device of claim 1, wherein the wefts of hair are attached in a desired direction according to a style desired by an individual wearer.

14. A method comprising:

coupling a device of claim 1 to an individual wearer's hair using an attachment device;

applying outside pressure to a foundation of the device to cause the foundation of the device to conform to the contours of the individual wearer's head; and drawing the individual wearer's hair through geometric regions of the device to blend the individual wearer's hair with wefts of hair sewn to the device.

15. The method of claim 14, wherein the device is coupled at a crown portion of an individual wearer's head.

16. The method of claim 14, wherein the individual wearer's hair is drawn through triangular geometric regions of the device in order to obscure the foundation of the device.

17. The method of claim 14, wherein a first portion of the device attaches to a crown portion of the individual wearer's head between an occipital bone and a top of a parietal portion of the wearer's head.

18. The method of claim 14, wherein a second portion of the device encloses a nape portion of the individual wearer's head between an occipital bone and a base of the individual wearer's scalp.

* * * * *